US011111555B2

(12) United States Patent
Honjo et al.

(10) Patent No.: US 11,111,555 B2
(45) Date of Patent: Sep. 7, 2021

(54) METHOD FOR PRODUCING RAIL

(71) Applicant: JFE STEEL CORPORATION, Tokyo (JP)

(72) Inventors: Minoru Honjo, Tokyo (JP); Tatsumi Kimura, Tokyo (JP); Katsuyuki Ichimiya, Tokyo (JP); Kazukuni Hase, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 240 days.

(21) Appl. No.: 16/488,343

(22) PCT Filed: Mar. 20, 2018

(86) PCT No.: PCT/JP2018/011191
§ 371 (c)(1),
(2) Date: Aug. 23, 2019

(87) PCT Pub. No.: WO2018/174094
PCT Pub. Date: Sep. 27, 2018

(65) Prior Publication Data

US 2020/0277682 A1 Sep. 3, 2020

(30) Foreign Application Priority Data

Mar. 21, 2017 (JP) ..... JP2017-054989

(51) Int. Cl.
*C21D 9/04* (2006.01)
*C21D 6/00* (2006.01)
(Continued)

(52) U.S. Cl.
CPC ..... *C21D 9/04* (2013.01); *C21D 6/002* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS 4,659,398 A 4/1987 Heller et al.
8,361,382 B2 1/2013 Honjo et al.
(Continued)

FOREIGN PATENT DOCUMENTS

CN 86100209 A 7/1986
CN 1178250 A 4/1998
(Continued)

OTHER PUBLICATIONS

Jun. 19, 2018, International Search Report issued in the International Patent Application No. PCT/JP2018/011191.
(Continued)

*Primary Examiner* — Brian D Walck
(74) *Attorney, Agent, or Firm* — Kenja IP Law PC

(57) ABSTRACT

A rail achieves a high 0.2% proof stress after straightening treatment, the high 0.2% proof stress being effective at improving rolling contact fatigue resistance of the rail, by hot rolling a steel raw material to obtain a rail, the steel raw material having a chemical composition containing C: 0.70% to 0.85%, Si: 0.1% to 1.5%, Mn: 0.4% to 1.5%, P: 0.035% or less, S: 0.010% or less, and Cr: 0.05% to 1.50% with the balance being Fe and inevitable impurities; straightening the rail with a load of 50 tf or more; and subsequently subjecting the rail to heat treatment in which the rail is held in a temperature range of 150° C. or more and 400° C. or less for 0.5 hours or more and 10 hours or less.

2 Claims, 3 Drawing Sheets

(51) Int. Cl.

| | |
|---|---|
| ***C21D 8/00*** | (2006.01) |
| ***C22C 38/00*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/42*** | (2006.01) |

(52) U.S. Cl.

CPC ..... *C21D 8/005* (2013.01); *C22C 38/002* (2013.01); *C22C 38/02* (2013.01); *C22C 38/04* (2013.01); *C22C 38/22* (2013.01); *C22C 38/24* (2013.01); *C22C 38/26* (2013.01); *C22C 38/28* (2013.01); *C22C 38/32* (2013.01); *C22C 38/42* (2013.01)

(56) References Cited

U.S. PATENT DOCUMENTS

| | | | | |
|---|---|---|---|---|
| 10,196,781 | B2 | 2/2019 | Han et al. | |
| 2008/0060726 | A1* | 3/2008 | Zhan ..... | C21D 9/04 148/581 |
| 2010/0186857 | A1 | 7/2010 | Honjo et al. | |
| 2016/0194729 | A1 | 7/2016 | Yong et al. | |
| 2017/0044721 | A1 | 2/2017 | Han et al. | |
| 2017/0191149 | A1 | 7/2017 | Kimura et al. | |
| 2018/0327880 | A1 | 11/2018 | Okushiro et al. | |

FOREIGN PATENT DOCUMENTS

| | | | |
|---|---|---|---|
| CN | 1978690 | A | 6/2007 |
| CN | 101405419 | A | 4/2009 |
| CN | 105018705 | A | 11/2015 |
| CN | 106460117 | A | 2/2017 |
| EP | 1900830 | A1 | 3/2008 |
| JP | H01139725 | A | 6/1989 |
| JP | H07185660 | A | 7/1995 |
| JP | 2000219939 | A | 8/2000 |
| JP | 5292875 | B2 | 9/2013 |
| JP | 5453624 | B2 | 3/2014 |
| JP | 5493950 | B2 | 5/2014 |
| SU | 344011 | A | 12/1972 |
| WO | 2016181891 | A1 | 11/2016 |

OTHER PUBLICATIONS

Apr. 15, 2020, Office Action issued by the IP Australia in the corresponding Australian Patent Application No. 2018240808.

Dec. 7, 2020, Office Action issued by the Canadian Intellectual Property Office in the corresponding Canadian Patent Application No. 3,054,643.

Sep. 23, 2020, Office Action issued by the China National Intellectual Property Administration in the corresponding Chinese Patent Application No. 201880014205.1 with English language search report.

A.A. Deryabin et al., Structure and Properties of Metals and Alloys—Quality of Rail Made From Steel Alloyed With Chromium and Vanadium, Steel in Translation, 2004, pp. 73-78, vol. 34, No. 1.

Dec. 18, 2019, the Extended European Search Report issued by the European Patent Office in the corresponding European Patent Application No. 18772424.0.

* cited by examiner

METHOD FOR PRODUCING RAIL

TECHNICAL FIELD

The disclosure relates to method for producing a rail, in particular a high-strength pearlitic rail. Specifically, because this kind of rail is used under severe high axle load conditions such as in mining railways which are weighted with heavy freight cars and often have steep curves, the disclosure provides a method for providing a high-strength pearlitic rail having excellent rolling contact fatigue resistance which is suitable for prolonging the rail service life.

BACKGROUND

In heavy haul railways mainly built to transport ore, the load applied to the axle of a freight car is much higher than that in passenger cars, and rails and wheels are used in increasingly harsh environments. For such a rail used in heavy haul railways, specifically, in railways on which trains and freight cars run with high loading weight, steel having a pearlite structure is conventionally primarily used, from the viewpoint of the importance of rolling contact fatigue resistance. In recent years, however, to increase loading weight on freight cars and improve the efficiency of transportation, there has been demand for further improvement of rolling contact fatigue resistance of rails.

Consequently, there have been made various studies for further improvement of rolling contact fatigue resistance. For example, JP 5292875 B (PTL 1) proposes a rail having excellent wear resistance, rolling contact fatigue resistance, and delayed fracture resistance, the rail having defined ratios of the Mn content and the Cr content, and of the V content and the N content. JP 5493950 B (PTL 2) proposes a method for producing a pearlitic rail having excellent wear resistance and ductility, in which the pearlitic rail has defined contents of C and Cu and is subjected to post heat treatment at heating temperature of 450° C. to 550° C. for 0.5 h to 24 h. JP 2000-219939 A (PTL 3) proposes a pearlitic rail having excellent wear resistance and surface damage resistance, the pearlitic rail having a defined C content and structure and further having a 0.2% proof stress of 600 MPa to 1200 MPa. JP 5453624 B (PTL 4) proposes a pearlite steel rail having a 0.2% proof stress of more than 500 MPa and less than 800 MPa, the pearlite steel rail having defined contents of C, Si, Mn, P, S, and Cr, and a defined sum of contents of C, Si, Mn, and Cr.

CITATION LIST

Patent Literatures

PTL 1: JP 5292875 B
PTL 2: JP 5493950 B
PTL 3: JP 2000-219939 A
PTL 4: JP 5453624 B

SUMMARY

Technical Problem

A rail obtained through hot rolling and accelerated cooling is typically subjected to straightening treatment to eliminate a bend of the rail. In this straightening treatment, the 0.2% proof stress is significantly decreased by the Bauschinger effect. Specifically, to impart straightness to a rail, for example, the rail has to be straightened with a load of 30 tf to 70 tf. When straightening treatment is performed with such a high load, the 0.2% proof stress after the straightening treatment is significantly decreased as compared with before the treatment.

Then, alloying elements need to be added to sufficiently enhance the 0.2% proof stress before straightening treatment of a rail, but adding a large amount of alloying elements rather causes an abnormal structure other than a pearlite structure. Thus, adding more alloying elements than the present level is difficult. Therefore, a decrease in the 0.2% proof stress caused by the Bauschinger effect needs to be prevented by a method other than the addition of alloying elements.

All the techniques described in PTL 1 to PTL 4, however, merely improve the 0.2% proof stress in a stage before a rail is subjected to straightening treatment. Any of the techniques cannot avoid a decrease in the 0.2% proof stress after straightening treatment.

Specifically, the technique described in PTL 1 defines a ratio of the Mn content and the Cr content, and a ratio of the V content and the N content, but the rail loses the 0.2% proof stress in straightening treatment as described above. Thus, the 0.2% proof stress cannot be sufficiently maintained after straightening treatment only by defining the ratio of alloying elements.

PTL 2 proposes to define contents of C and Cu and to perform post heat treatment at heating temperature of 450° C. to 550° C. for 0.5 h to 24 h, but the heating temperature is high only to decrease the 0.2% proof stress because of recovery of dislocation. Thus, the 0.2% proof stress is more decreased after straightening treatment.

The technique described in PTL 3 sets the C content to more than 0.85% and increases the amount of cementite, thus ensuring a high 0.2% proof stress. On the other hand, a decrease in elongation tends to cause cracking, thus making it difficult to ensure rolling contact fatigue resistance.

The pearlite steel rail of PTL 4 has a 0.2% proof stress as low as less than 800 MPa, and actually has difficulties to ensure rolling contact fatigue resi stance.

The disclosure has been developed in light of the above circumstances. It could be helpful to provide a method for achieving a high 0.2% proof stress in a rail after straightening treatment, the high 0.2% proof stress being effective at improving rolling contact fatigue resistance of the rail.

Solution to Problem

We studied to address this issue, and found that optimizing the chemical composition of a rail, and additionally, properly performing heating treatment after straightening treatment is effective at improving the 0.2% proof stress of a pearlitic rail which has been subjected to straightening treatment. Based on the findings, we completed the disclosure.

The disclosure is based on the findings described above and has the following primary features.

1. A method for producing a rail comprising: hot rolling a steel raw material to obtain a rail, the steel raw material having a chemical composition containing (consisting of), in mass %, C: 0.70% to 0.85%,
Si: 0.1% to 1.5%,
Mn: 0.4% to 1.5%,
P: 0.035% or less,
S: 0.010% or less, and
Cr: 0.05% to 1.50% with the balance being Fe and inevitable impurities; straightening the rail with a load of 50 tf or more; and subsequently subjecting the rail to heat treatment in which the rail is held in a temperature range of 150° C. or more and 400° C. or less for 0.5 hours or more and 10 hours or less.

2. The method for producing a rail according to 1., wherein the chemical composition further contains, in mass %, at least one selected from the group consisting of V: 0.30% or less,
Cu: 1.0% or less,
Ni: 1.0% or less,
Nb: 0.05% or less,
Mo: 0.5% or less,
Al: 0.07% or less,
W: 1.0% or less,
B: 0.005% or less, and
Ti: 0.05% or less.

Advantageous Effect

According to the disclosure, it is possible to provide a high-strength pearlitic rail which exhibits an excellent 0.2% proof stress after straightening treatment and thus can be suitably used in heavy haul railways.

DETAILED DESCRIPTION

Figure 1:
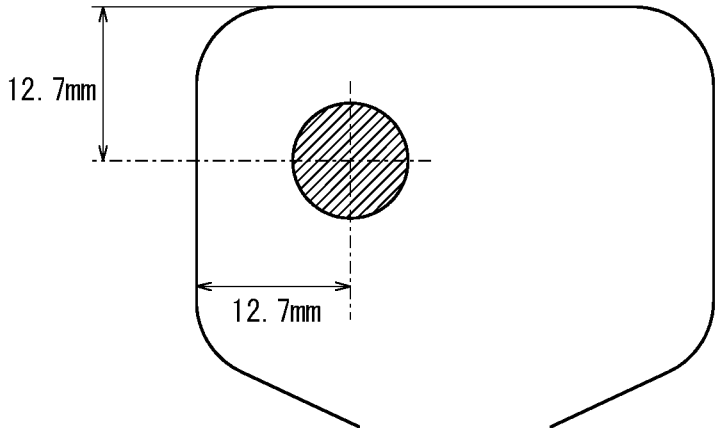
FIG. 1 is a schematic diagram of a rail head illustrating a collecting position of a tensile test piece.

Our method for producing a rail will be specifically explained below.

[Chemical Composition]

First, it is important that a steel raw material to produce a rail has the chemical composition described above. Reasons for limiting the chemical composition as described above are explained for each element. The unit of the content of each component is "mass %", but it is abbreviated as "%".

C: 0.70% to 0.85%

C is an element that forms cementite in a pearlite structure and has the effect of improving the 0.2% proof stress in heat treatment after straightening treatment. Therefore, the addition of C is necessary to ensure the 0.2% proof stress in a rail. As the C content increases, the 0.2% proof stress is improved. Specifically, when the C content is less than 0.70%, it is difficult to obtain an excellent 0.2% proof stress after the heat treatment. On the other hand, when the C content is beyond 0.85%, pro-eutectoid cementite is formed at prior austenite grain boundaries, ending up deteriorating rolling contact fatigue resistance of a rail. Therefore, the C content is set to 0.70% to 0.85%, and preferably, 0.75% to 0.85%.

Si: 0.1% to 1.5%

Si is an element that functions as a deoxidizer. Further, Si has an effect of improving the 0.2% proof stress of a rail by solid solution strengthening of ferrite in pearlite. Therefore, the Si content needs to be 0.1 or more. On the other hand, a Si content beyond 1.5% produces a large amount of oxide-based inclusions because Si has a high strength of bonding with oxygen, thus deteriorating rolling contact fatigue resistance. Therefore, the Si content is set to 0.1% to 1.5%, and preferably, 0.15% to 1.5%.

Mn: 0.4% to 1.5%

Mn is an element that improves the strength of a rail by decreasing the transformation temperature of steel to thereby shorten the lamellar spacing. A Mn content less than 0.4%, however, cannot achieve a sufficient effect. On the other hand, a Mn content beyond 1.5% tends to generate a martensite structure by microsegregation of steel, thus deteriorating rolling contact fatigue resistance. Therefore, the Mn content is set to 0.4% to 1.5%, and preferably, 0.4% to 1.4%.

P: 0.035% or less

A P content beyond 0.035% deteriorates ductility of a rail. Therefore, the P content is set to 0.035% or less. On the other hand, the lower limit of the P content is not limited, and may be 0%, although industrially more than 0%. Excessively decreasing the P content causes an increase in refining cost. Thus, from the perspective of economic efficiency, the P content is preferably set to 0.001% or more, and more preferably, 0.025% or less.

S: 0.010% or less

S exists in steel mainly in the form of an A type (sulfide-based) inclusion. A S content beyond 0.010% significantly increases the amount of the inclusions and generates coarse inclusions, thus deteriorating rolling contact fatigue resistance. Setting the S content to less than 0.0005% causes an increase in refining cost. Thus, from the perspective of economic efficiency, the S content is preferably set to 0.0005% or more, more preferably, 0.009% or less.

Cr: 0.05% to 1.50%

Cr is an element that has an effect of improving the 0.2% proof stress by solid solution strengthening of cementite in pearlite. To achieve this effect, the Cr content needs to be 0.05% or more. On the other hand, a Cr content beyond 1.50% generates a martensite structure by solid solution strengthening of Cr, ending up deteriorating rolling contact fatigue resistance. Therefore, the Cr content is set to 0.05% to 1.50%, and preferably 0.10% to 1.50%.

Our rail comprises the aforementioned composition as a steel raw material, with the balance being Fe and inevitable impurities. The balance may be Fe and inevitable impurities, and may further contain the following elements within a range which does not substantially affect the action and effect of the disclosure.

Specifically, the balance may further contain as necessary at least one selected from the group consisting of V: 0.30% or less,
Cu: 1.0% or less,
Ni: 1.0% or less,
Nb: 0.05% or less,
Mo: 0.5% or less,
Al: 0.07% or less,
W: 1.0% or less,
B: 0.005% or less, and
Ti: 0.05% or less.

V: 0.30% or less

V is an element that has an effect of precipitating as a carbonitride during and after rolling and improving the 0.2% proof stress by precipitation strengthening. Therefore, 0.001% or more of V is preferably added. On the other hand, a V content beyond 0.30% causes the precipitation of a large amount of coarse carbonitrides, thus deteriorating rolling contact fatigue resistance. Therefore, in the case of adding V, the V content is preferably set to 0.30% or less.

Cu: 1.0% or less

As with Cr, Cu is an element that has an effect of improving the 0.2% proof stress by solid solution strengthening. Therefore, 0.001% or more of Cu is preferably added. On the other hand, a Cu content beyond 1.0% causes Cu cracking. Therefore, in the case of adding Cu, the Cu content is preferably set to 1.0% or less.

Ni: 1.0% or less

Ni has an effect of improving the 0.2% proof stress without deteriorating ductility. Therefore, 0.001% or more of Ni is preferably added. In addition, adding Ni along with Cu can prevent Cu cracking. Thus, in the case of adding Cu, Ni is preferably added. On the other hand, a Ni content beyond 1.0% increases quench hardenability to produce martensite, deteriorating rolling contact fatigue resistance. Therefore, in the case of adding Ni, the Ni content is preferably set to 1.0% or less.

Nb: 0.05% or less

Nb precipitates as a carbonitride during and after rolling and improves the 0.2% proof stress of a pearlitic rail. Therefore, 0.001% or more of Nb is preferably added. On the other hand, a Nb content beyond 0.05% causes the precipitation of a large amount of coarse carbonitrides, thus deteriorating ductility. Therefore, in the case of adding Nb, the Nb content is preferably set to 0.05% or less.

Mo: 0.5% or less

Mo precipitates as a carbonitride during and after rolling and improves the 0.2% proof stress by precipitation strengthening. Therefore, 0.001% or more of Mo is preferably added. On the other hand, a Mg content beyond 0.5% produces martensite, thus deteriorating rolling contact fatigue resistance. Therefore, in the case of adding Mo, the Mo content is preferably set to 0.5% or less.

Al: 0.07% or less

Al is an element that is added as a deoxidizer. Therefore, 0.001% or more of Al is preferably added. On the other hand, an Al content beyond 0.07% produces a large amount of oxide-based inclusions because Al has a high strength of bonding with oxygen, thus deteriorating rolling contact fatigue resistance. Therefore, the Al content is preferably set to 0.07% or less.

W: 1.0% or less

W precipitates as a carbonitride during and after rolling and improves the 0.2% proof stress by precipitation strengthening. Therefore, 0.001% or more of W is preferably added. On the other hand, a W content beyond 1.0% produces martensite, thus deteriorating rolling contact fatigue resistance. Therefore, in the case of adding W, the W content is preferably set to 1.0% or less.

B: 0.005% or less

B precipitates as a nitride during and after rolling, and improves the 0.2% proof stress by precipitation strengthening. Therefore, 0.0001% or more of B is preferably added. A B content beyond 0.005% produces martensite, thus deteriorating rolling contact fatigue resistance. Therefore, in the case of adding B, the B content is preferably set to 0.005% or less.

Ti: 0.05% or less

Ti precipitates as a carbide, a nitride, or a carbonitride during and after rolling, and improves the 0.2% proof stress by precipitation strengthening. Therefore, 0.001% or more of Ti is preferably added. On the other hand, a Ti content beyond 0.05% produces coarse carbides, nitrides, or carbonitrides, thus deteriorating rolling contact fatigue resistance. Therefore, in the case of adding Ti, the Ti content is preferably 0.05% or less.

[Producing Conditions]

Next, a method for producing our rail will be described.

Our rail can be produced by making a rail through hot rolling and cooling according to a usual method and subsequently subjecting the rail to straightening treatment with loads of 50 tf or more, and then to heat treatment under predetermined conditions.

The rail is produced by hot rolling, for example, in accordance with the following procedures.

First, steel is melted in a converter or an electric heating furnace and subjected as necessary to secondary refining such as degassing.

Subsequently, the chemical composition of the steel is adjusted within the aforementioned range. Next, the steel is subjected to continuous casting to make a steel raw material such as bloom. Subsequently, the steel raw material is heated in a heating furnace to 1200° C. to 1350° C. and hot rolled to obtain a rail. The hot rolling is preferably performed at rolling finish temperature: 850° C. to 1000° C. and the rail after the hot rolling is preferably cooled at cooling rate: 1° C./s to 10° C./s.

Figure 3:
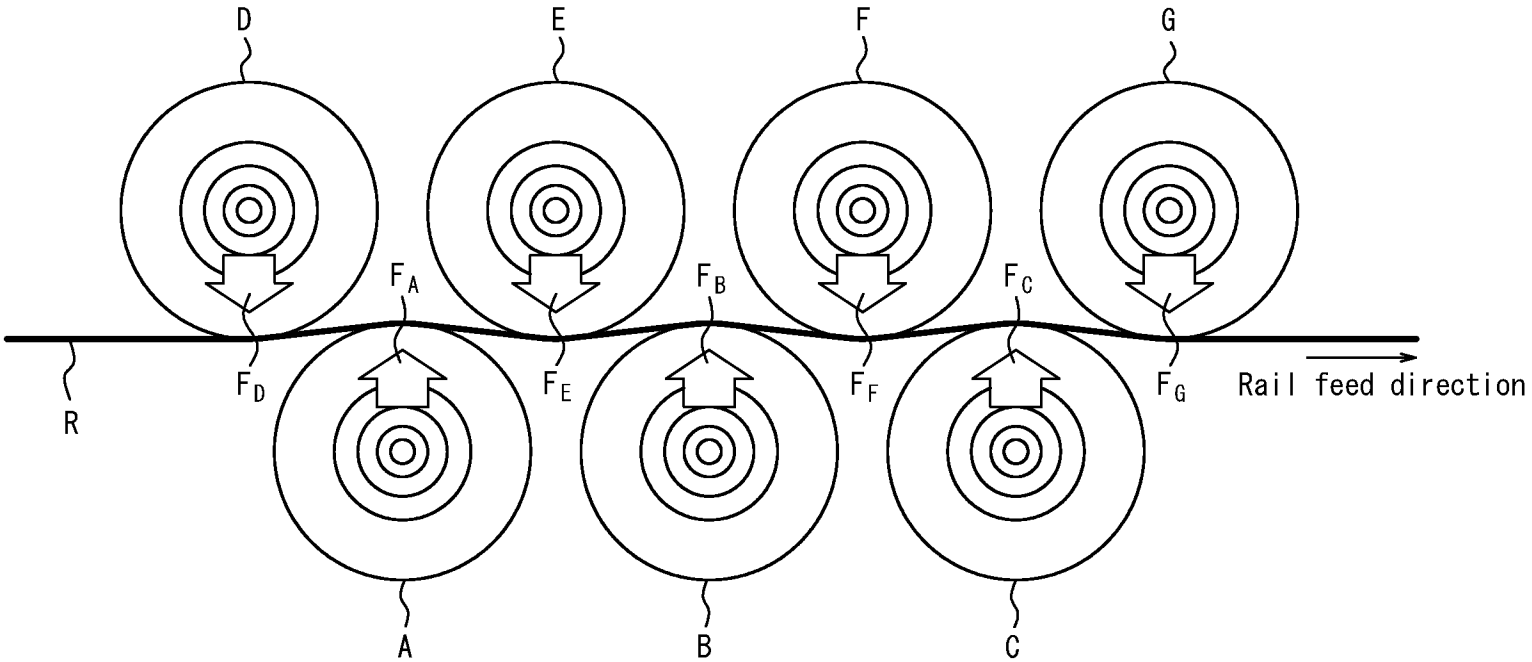
FIG. 3 is a schematic diagram illustrating an overview of bend straightening of a rail.

After the cooling following the hot rolling is finished, the rail is subjected to straightening treatment with loads of 50 tf or more to straighten a bend of the rail. The bend of the rail is straightened by passing the rail through straightening rollers disposed in zigzag along the feed direction of the rail and subjecting the rail to repeated bending/bend restoration deformation. FIG. 3 is a conceptual diagram illustrating a method for straightening a bend of the rail. The bend straightening of a rail is performed by passing a rail R through straightening rollers A to G disposed in zigzag along the feed direction of the rail. In FIG. 3, top surfaces of straightening rollers A, B, and C disposed below the feed line are arranged at an upper side than bottom surfaces of straightening rollers D, E, F and G disposed above the feed line. By passing the rail through the straightening roller group, the rail is subjected to bending/bend restoration deformation. During the straightening, at least one of straightening loads applied to the straightening rollers A to G is 50 tf or more. For example, in the example of FIG. 3, seven straightening rollers in total, that is, three straightening rollers in the lower side of the figure and four straightening rollers in the upper side of the figure are applied with straightening loads of $F_A$, $F_B$, $F_C$, $F_D$, $F_E$, $F_F$, and $F_G$, among which, the largest straightening load is 50 tf or more. When the straightening load is less than 50 tf, strains cannot be accumulated in the rail, and the heat treatment described below would not improve a 0.2% proof stress sufficiently, thus decreasing an improvement margin of rolling contact fatigue resistance.

Strains accumulated in the rail by straightening treatment is changed depending on the straightening load and the cross-sectional area of the rail (size of the rail) to be subjected to the straightening treatment. Here, the rail to be used under high axle load conditions which is mainly targeted in the disclosure has a size of 115 lbs, 136 lbs, and 141 lbs in the North America AREMA Standard which has a relatively large cross-section, and a size of 50 kgN and 60 kgN in the JIS Standard. When the rail having such a size is applied with a straightening load of 50 tf or more, enough strains can be accumulated in the rail to sufficiently improve a 0.2% proof stress after heat treatment.

After the straightening treatment, it is important to perform heat treatment in which a rail is held in a temperature range of 150° C. or more and 400° C. or less for 0.5 hours or more and 10 hours or less. Specifically, when the holding temperature is less than 150° C. or more than 400° C., improvement margins of a 0.2% proof stress and rolling contact fatigue resistance are decreased. Further, when the holding time in the temperature range is less than 0.5 hours or more than 10 hours, improvement margins of a 0.2% proof stress and rolling contact fatigue resistance are decreased. For the heat treatment, a furnace or a high-frequency heat treatment device can be used.

By subjecting a rail made from a steel raw material having the aforementioned chemical composition to the aforementioned heat treatment after the straightening treatment, a 0.2% proof stress after the heat treatment is improved by 40 MPa or more relative to a 0.2% proof stress before the heat treatment.

Specifically, to improve rolling contact fatigue resistance of the rail, the 0.2% proof stress of the rail needs to be improved to limit a plastic deformation area as much as possible. The 0.2% proof stress can be improved by adding alloying elements, which, however, rather deteriorates rolling contact fatigue resistance of the rail by the generation of an abnormal structure such as martensite. To prevent the generation of an abnormal structure and improve the 0.2% proof stress, heat treatment under the aforementioned conditions is effective. The 0.2% proof stress can be improved by performing optimal heat treatment.

As used herein, the "improvement margin of a 0.2% proof stress" can be determined as a difference between 0.2% proof stresses obtained in tensile tests before and after aging and heat treatment (a 0.2% proof stress after aging and heat treatment—a 0.2% proof stress before aging and heat treatment).

Example 1

Steel raw materials (bloom) having a chemical composition listed in Table 1 were hot rolled to obtain rails having a size listed in Table 2. At that time, the heating temperature before the hot rolling was 1250° C., and the delivery temperature was 900° C. The hot-rolled rails were cooled to 400° C. at an average rate of 3° C./s. Subsequently, the cooled rails were subjected to straightening treatment under conditions listed in Table 2, and then to heat treatment under conditions listed in Table 2. The rails of Comparative Examples of No. 1 and No. 2 were not subjected to heat treatment.

A tensile test was performed on each obtained rail to measure its 0.2% proof stress, tensile strength, and elongation. Further, a rolling contact fatigue resistance test was performed to measure rolling contact fatigue resistance of each rail. The measurement method was as follows.

[Tensile Test]

For heads of the obtained rails, tensile test pieces were collected from the portion illustrated in FIG. 1. Specifically, tensile test pieces having a diameter of parallel portion as described in ASTM A370 of 12.7 mm were collected from a position described in 2.1.3.4 of Chapter 4 of AREMA (see FIG. 1). Next, using the obtained tensile test pieces, a tensile test was performed under conditions of a tension speed of 1 mm/min and a gauge length of 50 mm to measure 0.2% proof stress, tensile strength, and elongation. The measurement values were listed in Table 2.

The tensile test was performed on test pieces of heads of the rails collected from immediately after the straightening treatment. For rails of No. 1 and No. 2, the tensile test was also performed on test pieces of heads of the rails collected 10 hours after the straightening treatment without the heat treatment. For the other rails than those of No. 1 and No. 2, the tensile test was also performed on test pieces of heads of the rails collected after the heat treatment under heat treatment conditions listed in Table 2.

[Rolling Contact Fatigue Resistance]

Figure 2A:
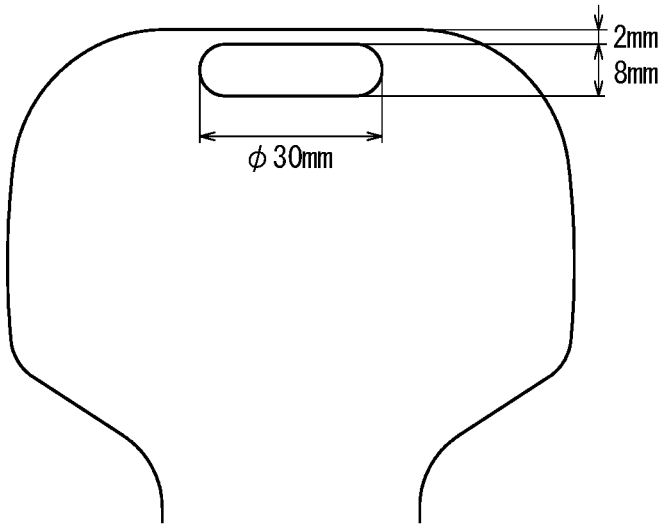
FIGS. 2A and 2B are each a schematic diagram of a rail head illustrating a collecting position of a rolling contact fatigue test piece.
Figure 2B:
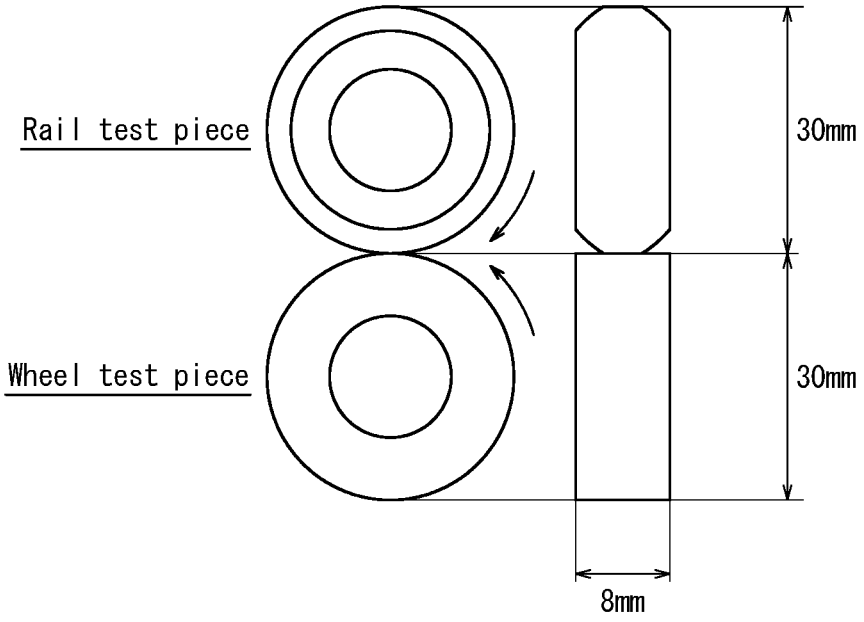

Rolling contact fatigue resistance was evaluated using a Nishihara type wear test apparatus and simulating actual contact conditions between a rail and a wheel. Specifically, cylinder test pieces having a diameter of 30 mm (an outer diameter of 30 mm and an inner diameter of 16 mm) with a contact surface being a curved surface having a radius of curvature of 15 mm were collected from heads of the rails as illustrated in FIG. 2A after the straightening treatment. Such pieces are also collected from heads of the rails as illustrated in FIG. 2A after the heat treatment or 10 hours after the straightening treatment without the heat treatment. The cylinder test pieces were fed to the test apparatus as illustrated in FIG. 2B with a contact pressure of 2.2 GPa and a slip rate of −20% under oil lubrication conditions. At the time when spalling occurred in a contact surface of the test pieces, the test pieces were determined to have reached their rolling contact fatigue life. As a standard when comparing the rolling contact fatigue life, an actually-used pearlite steel rail having the C content of 0.81% was adopted. When the rolling contact fatigue time was 10% or more longer than in the actually-used pearlite steel rail (A1), the rolling contact fatigue resistance was determined to have been improved.

The wheel material illustrated in FIGS. 2A and 2B was subjected to the test, the wheel material being obtained by heating a round bar with a diameter of 33 mm to 900° C., the bar having a chemical composition containing, in mass %, 0.76% C, 0.35% Si, 0.85% Mn, 0.017% P, 0.008% S, and 0.25% Cr with the balance being Fe and inevitable impurities, holding the bar for 40 minutes, subsequently allowing it to be naturally cooled, and forming it into a wheel material as illustrated in FIG. 2B. The hardness of the wheel material was HV280.

TABLE 1

| Steel sample | Chemical composition (mass %)* | | | | | | |
|---|---|---|---|---|---|---|---|
| ID | C | Si | Mn | P | S | Cr | Remarks |
| A1 | 0.81 | 0.25 | 1.18 | 0.009 | 0.005 | 0.25 | Conforming Steel |
| A2 | 0.84 | 0.51 | 0.62 | 0.011 | 0.004 | 0.77 | Conforming Steel |
| A3 | 0.69 | 0.24 | 0.82 | 0.008 | 0.007 | 0.15 | Comparative Steel |

*The balance is Fe and inevitable impurities

TABLE 2

| | | | | Heat treatment conditions | | Measurement results | | |
|---|---|---|---|---|---|---|---|---|
| | | | Straightening | Holding | Holding | Before heat treatment | | |
| No. | Steel sample ID | Size | load (tf) | temperature (° C.) | time (time) | 0.2% proof stress (Mpa) | Tensile strength (MPa) | Elongation (%) |
| 1 | A1 | 50 kgN | 80 | — | — | 921 | 1403 | 12.0 |
| 2 | A2 | 50 kgN | 80 | — | — | 932 | 1432 | 12.1 |
| 3 | A2 | 136 lbs | 80 | 140 | 0.5 | 933 | 1433 | 12.5 |
| 4 | A2 | 50 kgN | 80 | 140 | 10 | 932 | 1432 | 12.3 |
| 5 | A2 | 141 lbs | 50 | 150 | 0.5 | 934 | 1432 | 12.5 |

TABLE 2-continued

| | | | | | | | | |
|---|---|---|---|---|---|---|---|---|
| 6 | A2 | 50 kgN | 50 | 150 | 10 | 931 | 1433 | 12.3 |
| 7 | A2 | 136 lbs | 100 | 200 | 0.5 | 931 | 1440 | 12.5 |
| 8 | A2 | 141 lbs | 50 | 200 | 10 | 933 | 1439 | 12.6 |
| 9 | A2 | 50 kgN | 50 | 300 | 0.5 | 934 | 1432 | 12.5 |
| 10 | A2 | 141 lbs | 120 | 300 | 10 | 931 | 1433 | 12.7 |
| 11 | A2 | 50 kgN | 70 | 400 | 0.5 | 931 | 1433 | 12.8 |
| 12 | A2 | 141 lbs | 70 | 400 | 10 | 932 | 1433 | 12.5 |
| 13 | A2 | 50 kgN | 80 | 410 | 0.5 | 933 | 1439 | 12.5 |
| 14 | A2 | 141 lbs | 80 | 410 | 10 | 934 | 1438 | 12.4 |
| 15 | A2 | 50 kgN | 80 | 300 | 0.4 | 935 | 1440 | 12.4 |
| 16 | A2 | 136 lbs | 100 | 300 | 11 | 934 | 1431 | 12.4 |
| 17 | A3 | 50 kgN | 80 | 300 | 0.5 | 892 | 1387 | 12.7 |
| 18 | A3 | 50 kgN | 45 | 300 | 0.5 | 888 | 1389 | 12.8 |
| 19 | A2 | 136 lbs | 45 | 400 | 0.5 | 927 | 1435 | 12.6 |

| | Measurement results | | | | | |
|---|---|---|---|---|---|---|
| | After heat treatment | | | Improvement margin of 0.2% | Improvement margin of rolling contact fatigue | |
| No. | 0.2% proof stress (Mpa) | Tensile strength (MPa) | Elongation (%) | proof stress (MPa) | resistance (%) | Remarks |
| 1 | 922 | 1404 | 12.1 | 1 | Standard | Comparative Example |
| 2 | 935 | 1445 | 12.2 | 3 | 2 | Comparative Example |
| 3 | 945 | 1451 | 12.5 | 12 | 4 | Comparative Example |
| 4 | 952 | 1421 | 14.7 | 20 | 5 | Comparative Example |
| 5 | 981 | 1451 | 12.5 | 47 | 14 | Example |
| 6 | 993 | 1421 | 14.7 | 62 | 16 | Example |
| 7 | 979 | 1307 | 15.2 | 48 | 15 | Example |
| 8 | 1003 | 1288 | 15.6 | 70 | 20 | Example |
| 9 | 988 | 1434 | 12.4 | 54 | 15 | Example |
| 10 | 1003 | 1439 | 12.7 | 72 | 20 | Example |
| 11 | 971 | 1422 | 12.6 | 40 | 12 | Example |
| 12 | 994 | 1441 | 12.8 | 62 | 17 | Example |
| 13 | 966 | 1453 | 12.1 | 33 | 9 | Comparative Example |
| 14 | 951 | 1437 | 12.6 | 17 | 5 | Comparative Example |
| 15 | 966 | 1453 | 12.1 | 31 | 8 | Comparative Example |
| 16 | 959 | 1429 | 12.6 | 25 | 5 | Comparative Example |
| 17 | 911 | 1453 | 12.1 | 19 | 5 | Comparative Example |
| 18 | 922 | 1391 | 12.7 | 34 | 9 | Comparative Example |
| 19 | 927 | 1435 | 12.7 | 0 | 2 | Comparative Example |

The rail of Comparative Example No. 1 in Example 1 was an actually-used pearlitic rail having the C content of 0.81%. As seen from the results listed in Table 2, rails of Examples according to the disclosure had a more excellent 0.2% proof stress than the rail of Comparative Example No. 1 by 40 MPa or more and exhibited an improvement margin of rolling contact fatigue resistance of 10% or more. On the other hand, the rails of Comparative Examples which did not satisfy the conditions of the disclosure were inferior in at least one of 0.2% proof stress, elongation, and rolling contact fatigue resistance.

Example 2

Rails were made in the same procedures as in Example 1 other than using steel having a chemical composition listed in Table 3. A tensile test and measurement of rolling contact fatigue resistance were performed on the rails in the same way as in Example 1. Heat treatment conditions and the measurement results are presented in Table 4.

As seen from the results listed in Table 4, the rails of Examples satisfying the conditions of the disclosure had a more excellent 0.2% proof stress than the rail of Comparative Example No. 1 by 40 MPa or more and exhibited an improvement margin of rolling contact fatigue resistance of 10% or more. On the other hand, the rails of Comparative Examples which did not satisfy the conditions of the disclosure were inferior in at least one of 0.2% proof stress and rolling contact fatigue resistance.

TABLE 3

| Steel | Chemical Composition (mass %)* | | | | | | | | | | | | | | | |
|---|---|---|---|---|---|---|---|---|---|---|---|---|---|---|---|---|
| sample ID | C | Si | Mn | P | S | Cr | Cu | Ni | Mo | V | Nb | Al | W | B | Ti | Remarks |
| A1 | 0.81 | 0.25 | 1.18 | 0.011 | 0.006 | 0.25 | — | — | — | — | — | — | — | — | — | Conforming Steel |
| B1 | 0.83 | 1.50 | 0.49 | 0.014 | 0.007 | 0.26 | — | — | — | — | — | — | — | — | — | Conforming Steel |
| B2 | 0.83 | 0.25 | 0.85 | 0.005 | 0.007 | 0.61 | — | — | — | — | — | — | — | — | — | Conforming Steel |
| B3 | 0.70 | 0.42 | 0.40 | 0.003 | 0.006 | 1.50 | — | — | — | — | — | — | — | — | — | Conforming Steel |
| B4 | 0.84 | 0.88 | 0.46 | 0.016 | 0.005 | 0.79 | — | — | — | — | — | — | — | — | — | Conforming Steel |
| B5 | 0.83 | 0.87 | 0.47 | 0.003 | 0.006 | 1.46 | — | — | — | — | — | — | — | — | — | Conforming Steel |
| B6 | 0.84 | 0.22 | 1.20 | 0.005 | 0.007 | 0.21 | — | — | — | — | — | — | — | — | — | Conforming Steel |
| B7 | 0.81 | 0.69 | 0.56 | 0.015 | 0.007 | 0.79 | — | — | — | — | — | — | — | — | — | Conforming Steel |

TABLE 3-continued

| Steel sample ID | Chemical Composition (mass %)* C | Si | Mn | P | S | Cr | Cu | Ni | Mo | V | Nb | Al | W | B | Ti | Remarks |
|---|---|---|---|---|---|---|---|---|---|---|---|---|---|---|---|---|
| B8 | 0.71 | 1.16 | 1.34 | 0.016 | 0.004 | 0.88 | — | — | — | — | — | — | — | — | — | Conforming Steel |
| B9 | 0.84 | 1.06 | 0.83 | 0.019 | 0.006 | 0.05 | — | — | — | — | — | — | — | — | — | Conforming Steel |
| B10 | 0.85 | 0.48 | 0.71 | 0.016 | 0.004 | 0.32 | — | — | — | — | — | — | — | — | — | Conforming Steel |
| B11 | 0.68 | 0.25 | 0.81 | 0.015 | 0.006 | 0.05 | — | — | — | — | — | — | — | — | — | Comparative Steel |
| B12 | 0.86 | 0.24 | 0.81 | 0.015 | 0.007 | 0.22 | — | — | — | — | — | — | — | — | — | Comparative Steel |
| B13 | 0.72 | 0.04 | 0.81 | 0.015 | 0.005 | 0.21 | — | — | — | — | — | — | — | — | — | Comparative Steel |
| B14 | 0.82 | 1.55 | 0.82 | 0.014 | 0.005 | 0.99 | — | — | — | — | — | — | — | — | — | Comparative Steel |
| B15 | 0.72 | 0.25 | 0.34 | 0.015 | 0.005 | 0.18 | — | — | — | — | — | — | — | — | — | Comparative Steel |
| B16 | 0.84 | 0.29 | 1.55 | 0.011 | 0.005 | 0.99 | — | — | — | — | — | — | — | — | — | Comparative Steel |
| B17 | 0.81 | 0.63 | 0.81 | 0.006 | 0.003 | 0.01 | — | — | — | — | — | — | — | — | — | Comparative Steel |
| B18 | 0.85 | 0.59 | 0.81 | 0.007 | 0.003 | 1.55 | — | — | — | — | — | — | — | — | — | Comparative Steel |
| B19 | 0.84 | 0.55 | 0.55 | 0.014 | 0.005 | 0.79 | — | — | — | 0.05 | — | — | — | — | — | Conforming Steel |
| B20 | 0.84 | 0.51 | 0.61 | 0.008 | 0.004 | 0.74 | — | — | — | 0.15 | — | — | — | — | — | Conforming Steel |
| B21 | 0.84 | 0.25 | 1.10 | 0.006 | 0.005 | 0.25 | — | — | — | — | 0.04 | — | — | — | — | Conforming Steel |
| B22 | 0.84 | 0.35 | 1.05 | 0.003 | 0.004 | 0.29 | — | — | 0.30 | — | — | — | — | — | — | Conforming Steel |
| B23 | 0.84 | 0.55 | 0.55 | 0.011 | 0.005 | 0.62 | 0.30 | 0.50 | — | — | — | — | — | — | — | Conforming Steel |
| B24 | 0.84 | 0.25 | 1.20 | 0.004 | 0.005 | 0.29 | — | — | — | — | — | 0.07 | 0.60 | — | — | Conforming Steel |
| B25 | 0.84 | 0.88 | 0.55 | 0.005 | 0.005 | 0.45 | — | — | — | — | — | — | — | 0.003 | 0.05 | Conforming Steel |
| B26 | 0.84 | 0.95 | 0.56 | 0.011 | 0.005 | 0.79 | — | — | — | 0.05 | | — | — | — | — | Conforming Steel |

*The balance is Fe and inevitable impurities

TABLE 4

| No. | Steel sample ID | Size | Straightening load (tf) | Heat treatment conditions: Holding temperature (° C.) | Holding time (time) | Measurement results: Before heat treatment: 0.2% proof stress (Mpa) | Tensile strength (MPa) | Elongation (%) |
|---|---|---|---|---|---|---|---|---|
| 19 | A1 | 136 lbs | 80 | — | — | 921 | 1403 | 12.0 |
| 20 | B1 | 141 lbs | 80 | 200 | 4 | 933 | 1432 | 12.3 |
| 21 | B2 | 50 kgN | 80 | 300 | 4 | 929 | 1431 | 12.2 |
| 22 | B3 | 136 lbs | 80 | 300 | 10 | 887 | 1387 | 13.1 |
| 23 | B4 | 141 lbs | 80 | 200 | 6 | 933 | 1433 | 12.8 |
| 24 | B5 | 50 kgN | 80 | 300 | 3 | 952 | 1441 | 12.3 |
| 25 | B6 | 50 kgN | 80 | 300 | 10 | 918 | 1398 | 11.7 |
| 26 | B7 | 136 lbs | 80 | 300 | 10 | 929 | 1422 | 12.5 |
| 27 | B8 | 50 kgN | 80 | 400 | 10 | 929 | 1423 | 12.6 |
| 28 | B9 | 136 lbs | 80 | 300 | 0.5 | 934 | 1439 | 12.6 |
| 29 | B10 | 50 kgN | 80 | 300 | 6 | 929 | 1422 | 12.3 |
| 30 | B11 | 141 lbs | 80 | 300 | 3 | 889 | 1377 | 12.4 |
| 31 | B12 | 136 lbs | 80 | 300 | 0.5 | 948 | 1421 | 9.5 |
| 32 | B13 | 50 kgN | 80 | 300 | 2 | 892 | 1387 | 12.2 |
| 33 | B14 | 136 lbs | 80 | 300 | 4 | 944 | 1429 | 12.3 |
| 34 | B15 | 50 kgN | 80 | 300 | 3 | 889 | 1387 | 12.3 |
| 35 | B16 | 136 lbs | 80 | 300 | 3 | 921 | 1428 | 12.4 |
| 36 | B17 | 141 lbs | 80 | 300 | 5 | 879 | 1399 | 12.2 |
| 37 | B18 | 50 kgN | 80 | 300 | 6 | 922 | 1432 | 12.3 |
| 38 | B19 | 136 lbs | 100 | 300 | 3 | 933 | 1433 | 12.4 |
| 39 | B20 | 50 kgN | 50 | 250 | 4 | 942 | 1439 | 12.5 |
| 40 | B21 | 136 lbs | 80 | 300 | 4 | 934 | 1433 | 12.1 |
| 41 | B22 | 136 lbs | 50 | 300 | 2 | 929 | 1438 | 12.0 |
| 42 | B23 | 50 kgN | 80 | 250 | 6 | 941 | 1432 | 12.3 |
| 43 | B24 | 136 lbs | 80 | 350 | 3 | 923 | 1430 | 12.2 |
| 44 | B25 | 141 lbs | 50 | 300 | 6 | 923 | 1439 | 12.2 |
| 45 | B26 | 136 lbs | 80 | 300 | 1 | 931 | 1423 | 12.3 |

| No. | Measurement results: After heat treatment: 0.2% proof stress (Mpa) | Tensile strength (MPa) | Elongation (%) | Improvement margin of 0.2% proof stress (MPa) | Improvement margin of rolling contact fatigue resistance (%) | Remarks |
|---|---|---|---|---|---|---|
| 19 | 922 | 1404 | 12.1 | 1 | Standard | Comparative Example |
| 20 | 972 | 1435 | 12.4 | 39 | 11 | Example |
| 21 | 974 | 1439 | 12.3 | 45 | 13 | Example |
| 22 | 927 | 1389 | 12.9 | 40 | 11 | Example |
| 23 | 983 | 1432 | 12.7 | 50 | 14 | Example |

TABLE 4-continued

| | | | | | | |
|---|---|---|---|---|---|---|
| 24 | 995 | 1442 | 12.3 | 43 | 13 | Example |
| 25 | 960 | 1423 | 11.5 | 42 | 13 | Example |
| 26 | 974 | 1429 | 12.2 | 45 | 14 | Example |
| 27 | 978 | 1423 | 12.4 | 49 | 15 | Example |
| 28 | 974 | 1438 | 12.5 | 40 | 12 | Example |
| 29 | 980 | 1430 | 12.4 | 51 | 16 | Example |
| 30 | 921 | 1387 | 12.3 | 32 | 9 | Comparative Example |
| 31 | 989 | 1420 | 9.2 | 41 | 9 | Comparative Example |
| 32 | 931 | 1389 | 12.2 | 39 | 9 | Comparative Example |
| 33 | 984 | 1430 | 12.3 | 40 | 9 | Comparative Example |
| 34 | 920 | 1392 | 12.5 | 31 | 7 | Comparative Example |
| 35 | 963 | 1429 | 12.4 | 42 | 8 | Comparative Example |
| 36 | 917 | 1401 | 12.2 | 38 | 8 | Comparative Example |
| 37 | 965 | 1433 | 12.3 | 43 | 7 | Comparative Example |
| 38 | 984 | 1430 | 12.4 | 51 | 15 | Example |
| 39 | 984 | 1433 | 12.2 | 42 | 11 | Example |
| 40 | 979 | 1435 | 12.1 | 45 | 13 | Example |
| 41 | 969 | 1439 | 12.4 | 40 | 11 | Example |
| 42 | 983 | 1433 | 12.3 | 42 | 12 | Example |
| 43 | 968 | 1439 | 12.4 | 45 | 14 | Example |
| 44 | 968 | 1440 | 12.5 | 45 | 14 | Example |
| 45 | 974 | 1433 | 12.3 | 43 | 12 | Example |

The invention claimed is:

1. A method for producing a rail comprising:

hot rolling a steel raw material to obtain a rail, the steel raw material having a chemical composition containing, in mass %, C: 0.70% to 0.85%, Si: 0.1% to 1.5%, Mn: 0.4% to 1.5%, P: 0.035% or less, S: 0.010% or less, and Cr: 0.05% to 1.50% with the balance being Fe and inevitable impurities;

straightening the rail with a load of 50 tf or more; and subsequently subjecting the rail to heat treatment in which the rail is held in a temperature range of 150° C. or more and 400° C. or less for 0.5 hours or more and 10 hours or less.

2. The method for producing a rail according to claim 1, wherein the chemical composition further contains, in mass %, at least one selected from the group consisting of V: 0.30% or less, Cu: 1.0% or less, Ni: 1.0% or less, Nb: 0.05% or less, Mo: 0.5% or less, Al: 0.07% or less, W: 1.0% or less, B: 0.005% or less, and Ti: 0.05% or less.

* * * * *